US006795989B2

(12) United States Patent
Fairchild et al.

(10) Patent No.: US 6,795,989 B2
(45) Date of Patent: Sep. 28, 2004

(54) AIR ASSIST DEVICE FOR BED LINEN CHANGING

(76) Inventors: William G. Fairchild, 1120 Harbor Dr., Venice, FL (US) 34285; Virginia L. Fairchild, 1120 Harbor Dr., Venice, FL (US) 34285

( * ) Notice: Subject to any disclaimer, the term of this patent is extended or adjusted under 35 U.S.C. 154(b) by 0 days.

(21) Appl. No.: 10/341,614

(22) Filed: Jan. 14, 2003

(65) Prior Publication Data

US 2004/0133978 A1 Jul. 15, 2004

(51) Int. Cl.[7] ..... A47C 21/02
(52) U.S. Cl. ..... 5/488; 5/659; 5/660
(58) Field of Search ..... 5/488, 510, 659, 5/713, 615, 660

(56) References Cited

U.S. PATENT DOCUMENTS

| | | | | | |
|---|---|---|---|---|---|
| 3,606,623 | A | | 9/1971 | Aymar | |
| 3,781,928 | A | | 1/1974 | Swallert | |
| 3,895,404 | A | * | 7/1975 | Wilson | 5/482 |
| 4,142,263 | A | * | 3/1979 | Pierson | 5/660 |
| 4,309,783 | A | | 1/1982 | Cammack et al. | |
| 4,488,323 | A | | 12/1984 | Colburn | |
| 4,527,298 | A | | 7/1985 | Moulton | |
| 4,625,348 | A | | 12/1986 | Renggli et al. | |
| 4,807,313 | A | * | 2/1989 | Ryder et al. | 5/610 |
| 4,839,932 | A | | 6/1989 | Williamson | |
| 5,257,430 | A | * | 11/1993 | Yamaguchi | 5/659 |
| 5,285,542 | A | | 2/1994 | West et al. | |
| 5,313,679 | A | * | 5/1994 | Yamaguchi | 5/659 |
| 5,353,456 | A | | 10/1994 | Evans | |
| 5,425,150 | A | | 6/1995 | Palmer, Jr. et al. | |
| 5,522,099 | A | * | 6/1996 | Heier | 5/606 |
| 6,012,186 | A | | 1/2000 | Soltani et al. | |
| 6,421,857 | B2 | | 7/2002 | Whatman et al. | |

* cited by examiner

*Primary Examiner*—Michael F. Trettel
(74) *Attorney, Agent, or Firm*—Allan O. Maki; Foster, Swift, Collins & Smith, P.C.

(57) ABSTRACT

An assist device for facilitating bedding changes on a mattress includes an inflatable pneumatic bladder adapted to be positioned under a mattress. The bladder has a length and width somewhat less than those of the mattress. The pneumatic bladder is enclosed and is provided with an opening which is in fluid flow communication with a source of compressed gas, preferably a compressor. A switch is provided for controllably activating flow of compressed gas from the source into the bladder. The bladder may be configured with recessed sections so that the volume of air or other gas required to inflate said bladder is minimized. An opening to enable escape of compressed gas from the bladder may be provided in the compressor or may be valve extending through a surface of the bladder.

9 Claims, 4 Drawing Sheets

AIR ASSIST DEVICE FOR BED LINEN CHANGING

FIELD OF INVENTION

This invention relates to an assist device to provide assistance in changing of bedding. More particularly, the invention relates to such a device which utilizes a specially configured pneumatic bladder to raise a mattress to facilitate changing of bedding by a person of impaired strength or mobility.

BACKGROUND OF THE INVENTION

The types of mattresses contemporaneously in use have gradually increased in dimensions and weight. For example, types of mattresses typically in use have increased over a period of time from "full size" to "queen size" to "king size" to "super king" while at the same time the thickness of such mattresses has increased due to application of quilting or similar padding on both sides of the mattress, providing what is referred to as "pillow-top" mattresses. While such mattresses increase sleeping comfort for the users, the changing of linens, especially fitted bottom sheets becomes physically more difficult. Such difficulties especially provide a burden to persons who are physically infirm due to pregnancy, back pain, injuries, surgery, advancing age and the like. Such persons generally are unable to lift heavy mattresses contemporaneously in use. Therefore, especially for persons of limited means who may be unable to hire a suitable service provider, assist devices are needed in order to enable such homemakers of limited strength to change bedding while maintaining independence. Additionally assist devices are needed in order for many individuals to have the choice to select or retain contemporaneous bed designs that incorporate footboards that restrict access to the mattress, such as the "sleigh bed" design. These popular bed designs typically make the changing of bedding even more physically difficult and are only practical for physically fit persons.

SUMMARY OF THE INVENTION

In accordance with the invention, an assist device filling the aforementioned needs is provided. In accordance with the invention, such a device utilizes an inflatable bladder positioned under a mattress to raise the mattress above a box spring or other supporting surface. A controllable source of compressed gas, preferably a compressor, is connected in fluid flow communication with the bladder.

In accordance with another aspect of the invention a lift device for a mattress is provided which is concealed to the extent that typically only an electrical cord and a control pad for actuating the flow of compressed gas into the bladder are visible to the casual observer.

In accordance with yet another aspect of the invention, a lift device is provided which in its deflated condition, fits substantially concealed between a mattress and a box spring. In accordance with a related aspect of the invention, the lift device is dimensioned so that in its inflated condition it has a length and width slightly smaller than those of the mattress and box spring in connection with which it is adapted to be used.

Briefly, the invention provides an assist device for facilitating a change of bedding on a mattress which includes an inflatable pneumatic bladder adapted to be positioned under a mattress. The bladder has a length and width somewhat less than those of the mattress. The pneumatic bladder is enclosed and is provided with an opening that is in fluid flow communication with a source of compressed gas, preferably a compressor. A switch, either hard-wired or cordless remote is provided for controllably activating flow of compressed gas from the source into the bladder. The bladder may be configured with recessed sections so that the volume of air or other gas required to inflate said bladder is minimized. An opening to enable escape of compressed gas from the bladder may be provided in the compressor or, optionally, may be a valve extending through a surface of the bladder.

Various other features of the invention will be set forth in greater detail in the following detailed description, claims and accompanying drawings.

DETAILED DESCRIPTION OF THE INVENTION

Figure 1:
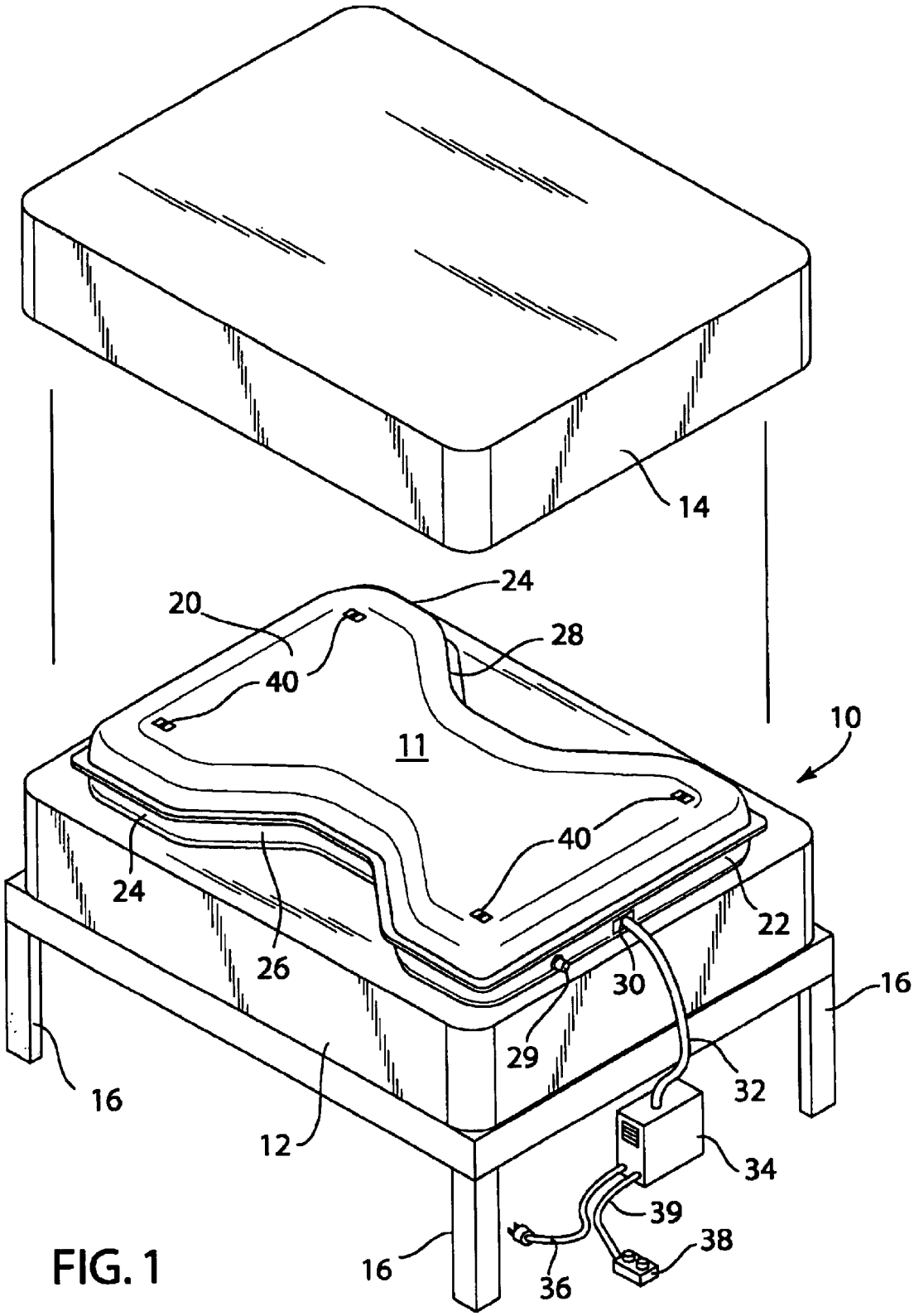
FIG. 1 is a perspective view showing an assist device of this invention in connection with a mattress and box spring.

Referring more particularly to the drawings, there is seen in FIG. 1 a pneumatic lift device 10 of this invention. Lift device 10 includes an inflatable bladder 11 which is adapted to be positioned between a box spring 12 and a mattress 14. Box spring 12 is illustrated as being supported on legs 16 for purposes of illustration, but it will be understood that any type of bed frame, including headboards, footboards, side rails and other supporting structures, may be used.

In the preferred embodiment illustrated in FIG. 1, the lift device 10 includes an air bladder 11 of a completely enclosed type formed by a top panel 20 and a corresponding bottom panel (not visible) which are connected by end panels 22 and side panels 24. Side panels 24 are preferably recessed at opposite sides 26 and 28 in order to reduce the volume of air required to inflate the pneumatic bladder.

Velcro® hook and loop type pads 40 can be attached to the top of the bladder to assist in holding and positioning a mattress pad, blanket or mattress thereover. Other fasteners can be substituted such as snap fasteners, buttons, or the like. Generally, any commercially available flexible rubber or other flexible polymeric material such as a vinyl plastic can be used as materials of construction in manufacture of pneumatic bladder 11.

A fitting 30 is provided to receive an air conduit 32 preferably near the headboard or head end panel 22. Conduit or hose 32 is connected to an air compressor or pump assembly 34. Air pump assembly 34 includes an air pump 33 which is preferably electrically powered and connected to an electrical outlet by a conventional cord 36. A switch 38 is provided for the purpose of activation of the air pump 33. For purposes of illustration switch 38 is shown as being connected by means of an electrical cord 39. However, it will be understood that the switch 38 can also be of a cordless type to remotely activate the air pump 33.

Figure 3:
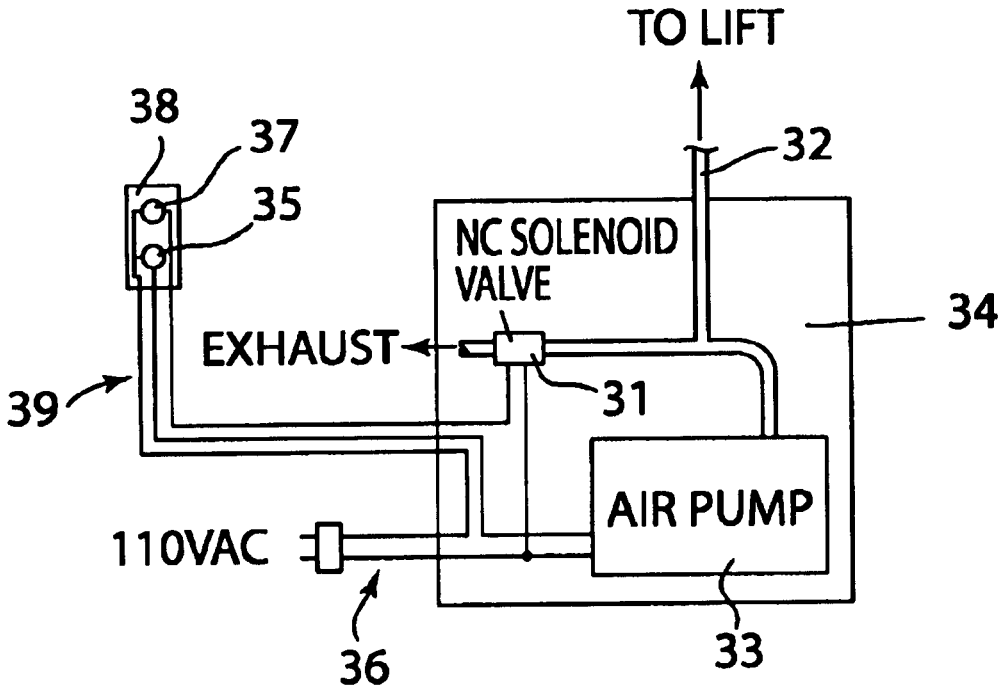
FIG. 3 is a diagrammatic view showing an air pump assembly and controls therefor which are suited for use in connection with the invention.
Figure 4:
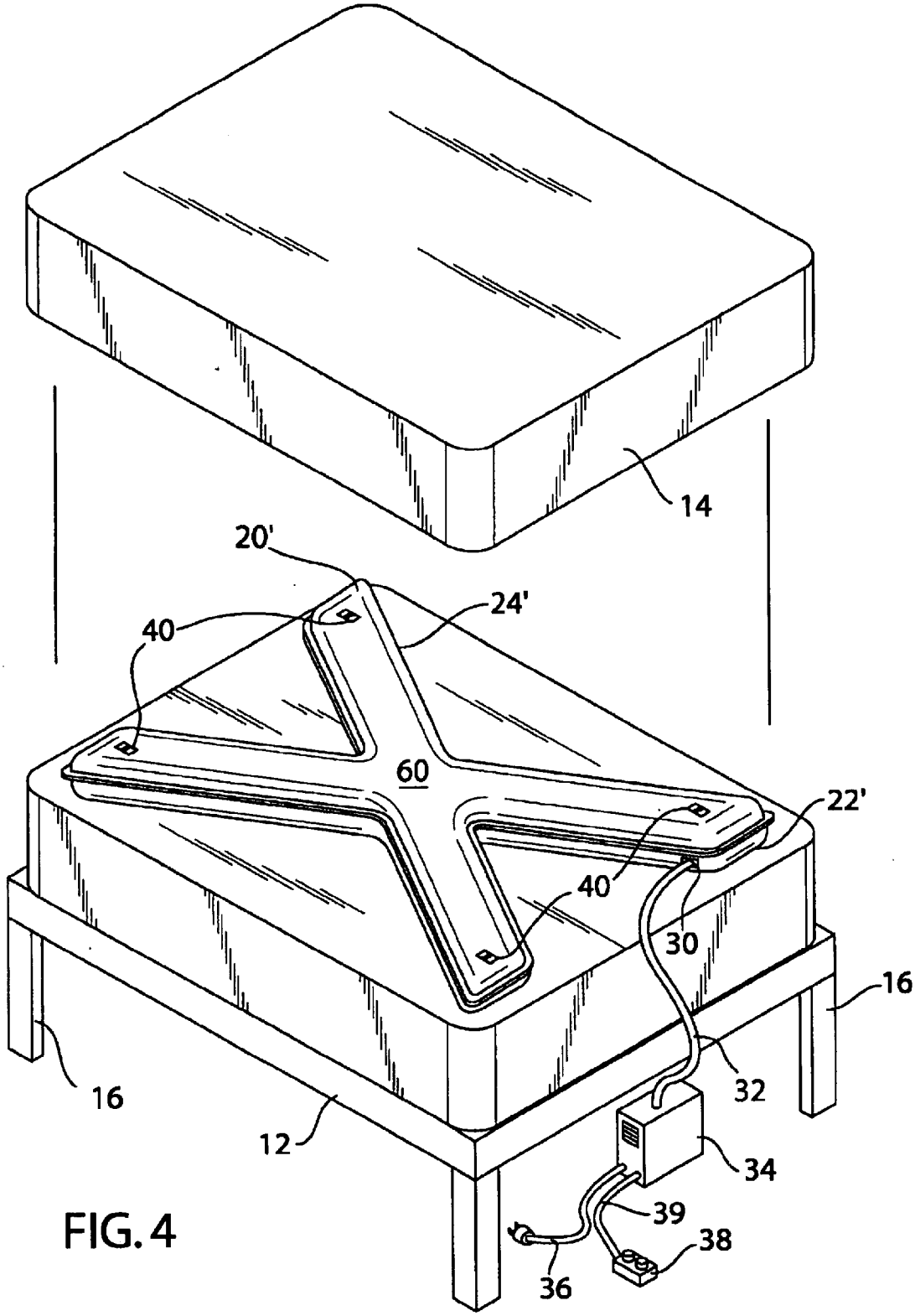
FIG. 4 is a perspective view showing an assist device of FIG. 2 in combination with a mattress and box spring.

Switch 38 can include one, two or more switches. In the embodiment illustrated in FIG. 3, two switches 35 and 37 are provided. In the illustrated arrangement button 35 is depressed to activate running of pump 33 thereby inflating the bladder 11. Release of button 35 and depressing of button 37 activates a solenoid to open an exhaust valve 31 allowing the weight of the mattress 14 to force air out of the bladder 11. Optionally, a separate opening 29 can be provided in order to allow for a controlled slow leak of air from the bladder. The opening can be of appropriate cross section to retain enough air to allow time for a bedding change but to allow flattening of the bladder over a period of time, for example, one-half hour. This ensures lowering of mattress 14 in the event the homemaker is distracted, for example, by a telephone call or door bell, or in the event of loss of electricity. The likelihood of injury to children in the household who may climb onto the raised mattress is thus minimized. Also, a loss of electricity or pump failure will not render the bed unusable.

As noted, opening 29 can be provided through a wall of the bladder to enable a controlled escape of gas therefrom. It may be advantageous to provide a needle valve or the like to allow a controlled slow leak whereby the bedding can be changed while the mattress is raised but the bladder is slowly allowed to flatten as air subsequently escapes.

Figure 2:
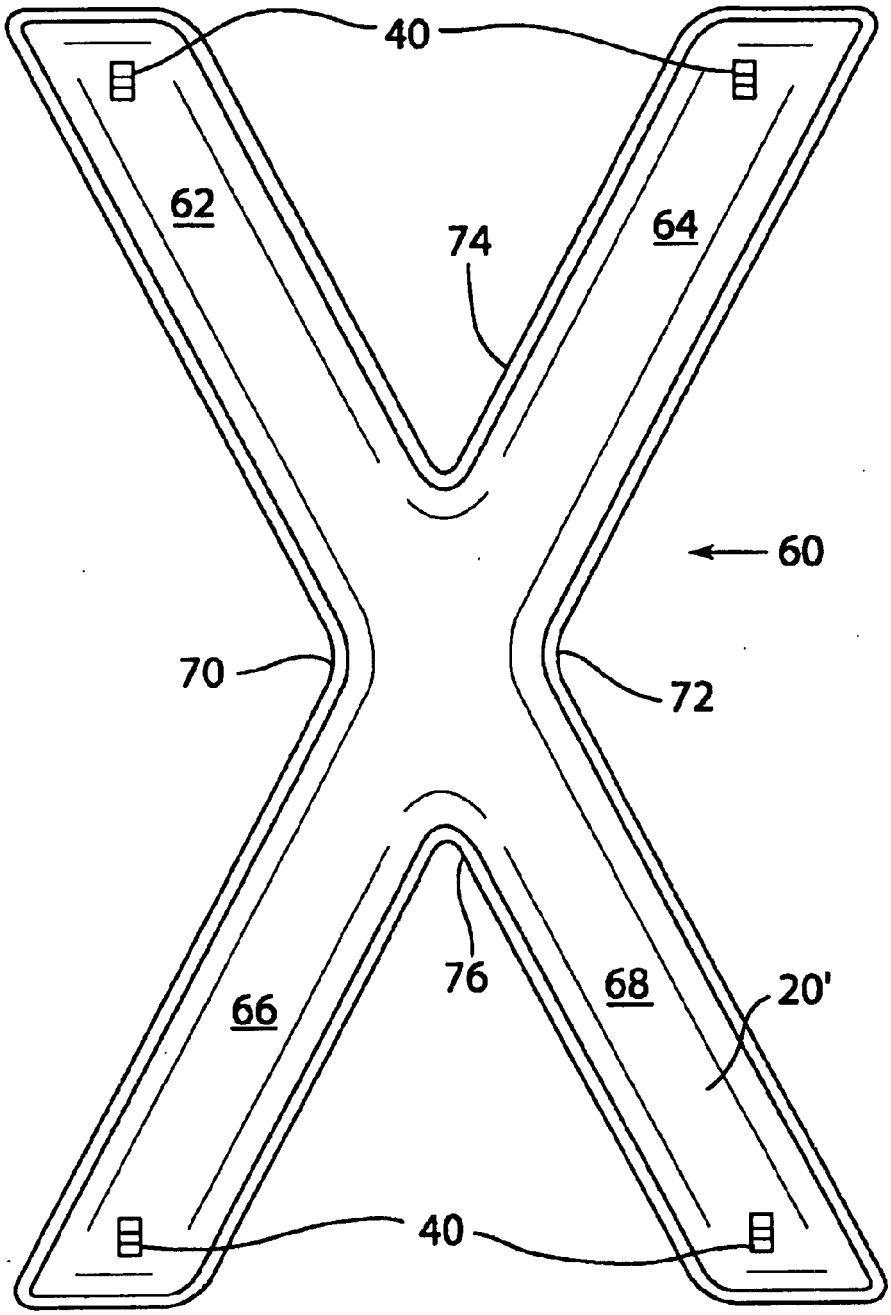
FIG. 2 is a top plan view of a pneumatic bladder for an assist device in accordance with a modified embodiment of the invention.

In the alternative embodiment of FIG. 2, the inflatable bladder 60 is of a generally X-shaped configuration formed by diagonally extending arms 62, 64, 66, and 68 including top panels 20', end panels 22' and side panels 24'. The configuration enables the inflatable bladder 60 to raise each of the corners of a mattress placed over the bladder while minimizing the volume of air required for inflation of the bladder by virtue of the cut-a-way sections 70, 72, 74 and 76.

As in the case of FIG. 1, Velcro® hook and loop type pads 40 can be attached to the top of the bladder to assist in positioning a mattress, mattress pad or blanket thereover or to enable the addition of accessories using cooperating pads. Such accessories and articles, if desired, can be provided with cooperating hooks or loops, or if a hook-shaped configuration is used on the pads 40, there may be sufficient penetration of a loosely knit blanket, for example, to assist in holding the same in position over the bladder. Accessories can be provided to assist in holding of sheets or blankets, for example, an elastic strap connected to a clip or clamping device which may, in turn, be clipped or clamped to the corner of a bedding sheet to hold the same in place. Additional accessories can include retention devices for bed skirts. Cooperating pads, of course, may be applied to the underside of a mattress positioned over the bladder, as well. Pads 40, while illustrated as being oriented parallel to the sides of mattress 14, can optionally be angled toward the corners thereof, or placed in other positions on the top or bottom of the bladder to accommodate the foregoing accessories or custom features, as desired.

While specific shapes have been shown herein for the air bladder, it will be understood that such shapes are shown for purposes of illustration rather than limitation. Other shapes such as an "I-shaped" or "H-shaped" configuration can be used equally well to achieve the objectives of the invention. In any of the various alternative bladder configurations or shapes suitable for use in practice of the invention it will be noted that the maximum overall length is less than that of the head-to-foot length of a mattress for which the bladder is adapted for use. Similarly, the maximum overall width of the bladder is less than that of the side-to-side width of the mattress.

Various modifications of the apparatus of the present invention will become apparent to those skilled in the art from examination of the above specification and drawings. Such modifications which are equivalent should thus be considered to be within the true scope of the appended claims.

We claim:

1. An assist device for facilitating a change of bedding on a mattress comprising:

an inflatable pneumatic bladder adapted to be positioned under a mattress, said mattress having a first length and a first width, said bladder having an overall length less than said first length and an overall width less than said first width, said bladder being enclosed and being provided with an opening which is in fluid flow communication with a source of compressed gas, fasteners being attached adjacent to each of the corners of said bladder for holding bedding material in a selected position relative to said bladder; and a switch for controllably activating flow of compressed gas from said source into said bladder.

2. A device according to claim 1 wherein said switch is a remote cordless switch.

3. A device according to claim 1 wherein said device is provided with an opening to enable escape of compressed gas from said bladder to enable flattening of said bladder after change of said bedding.

4. A device according to claim 3 wherein said opening comprises a needle vale extending through a surface of said bladder.

5. A device according to claim 1 wherein said source of compressed gas comprises an electrically powered compressor and a switch is provided for remote actuation thereof.

6. A device according to claim 5 wherein an opening controllable by said switch is provided for escape of compressed gas from said bladder.

7. A device according to claim 1 wherein said fasteners comprise hook and loop fasteners.

8. A device according to claim 1 wherein said fasteners are attached adjacent to each of the corners of said bladder.

9. An assist device for facilitating a change of bedding on a mattress comprising:

an inflatable pneumatic bladder adapted to be positioned under a mattress, said mattress having a first length and a first width, said bladder having an overall length less than said first length and an overall width less than said first width, said bladder being enclosed and being provided with an opening which is in fluid flow communication with a source of compressed gas, said bladder being of an X-shaped, I-shaped or H-shaped configuration and being configured to extend into close proximity to each corner of said mattress while intermediate sections thereof are recessed whereby the volume of air required to inflate said bladder is minimized; and a switch for controllably activating flow of compressed gas from said source into said bladder.

* * * * *